US007638737B2

(12) United States Patent
Sakurai et al.

(10) Patent No.: US 7,638,737 B2
(45) Date of Patent: Dec. 29, 2009

(54) CERAMIC-METAL ASSEMBLY AND CERAMIC HEATER

(75) Inventors: Kikuo Sakurai, Gifu (JP); Yasuhiro Takagi, Aichi (JP); Kuniharu Tanaka, Komaki (JP); Masahito Suzuki, Seki (JP)

(73) Assignee: NGK Spark Plug Co., Ltd., Aichi (JP)

( * ) Notice: Subject to any disclaimer, the term of this patent is extended or adjusted under 35 U.S.C. 154(b) by 362 days.

(21) Appl. No.: 11/452,929

(22) Filed: Jun. 15, 2006

(65) Prior Publication Data

US 2006/0283849 A1 Dec. 21, 2006

(30) Foreign Application Priority Data

Jun. 16, 2005 (JP) ..... P.2005-176903

(51) Int. Cl.
*H05B 3/68* (2006.01)
*H05B 3/08* (2006.01)

(52) U.S. Cl. ..... 219/444.1; 219/541

(58) Field of Classification Search ..... 219/444.1, 219/541–553; 338/306–314; 428/446–448
See application file for complete search history.

(56) References Cited

U.S. PATENT DOCUMENTS 4,695,517 A * 9/1987 Okuno et al. ..... 428/698
4,697,165 A * 9/1987 Ishiguro et al. ..... 338/34
4,834,863 A 5/1989 Yamada et al.
5,560,851 A * 10/1996 Thimm et al. ..... 219/543
5,756,215 A * 5/1998 Sawamura et al. ..... 428/446
6,118,110 A 9/2000 Kobayashi et al.
6,121,590 A 9/2000 Kobayashi et al.
6,131,796 A 10/2000 Kaja et al.

FOREIGN PATENT DOCUMENTS

| | | |
|---|---|---|
| GB | 2223385 A | 4/1990 |
| JP | 49-76711 | 7/1974 |
| JP | 57-82188 | 5/1982 |
| JP | 58-120579 | 7/1983 |
| JP | 11-292649 | 10/1999 |
| JP | 2003-347012 A | 12/2003 |

OTHER PUBLICATIONS

European Search Report dated Dec. 19, 2008.

* cited by examiner

*Primary Examiner*—Sang Y Paik
(74) *Attorney, Agent, or Firm*—Sughrue Mion, PLLC

(57) ABSTRACT

A ceramic-metal assembly including: a ceramic base; an electrode pad provided on a surface of the ceramic base; a connection terminal for external electrical connection; and a joining portion which joins the connection terminal to the electrode pad. The electrode pad has a first layer which is in contact with the ceramic base and a second layer which is in contact with the joining portion. The first layer contains 20 to 50 vol % of a ceramic component, and the second layer contains a component of the joining portion.

15 Claims, 3 Drawing Sheets

CERAMIC-METAL ASSEMBLY AND CERAMIC HEATER

BACKGROUND OF THE INVENTION

1. Field of the Invention

The present invention relates to a ceramic-metal assembly and a ceramic heater. More specifically, the invention relates to a ceramic heater including an electrode pad of a ceramic-metal assembly having increased adhesion to its ceramic base and a connection terminal.

2. Description of the Related Art

Conventionally, ceramic heaters in which a heating resistor made of a refractory metal such as tungsten or molybdenum is buried in a ceramic base made of alumina or the like are widely used. For example, a ceramic heater that is inserted in a sensor element of a gas sensor is formed by winding a ceramic green sheet incorporating a heating resistor around a ceramic porcelain tube and firing the resulting assembly to form an integral body. The ceramic beater, on its outer circumferential surface, also has electrode pads that are electrically connected to the heating resistor. Also, connection terminals for applying an external voltage to the heating resistor are brazed to the respective electrode pads. Like the heating resistor, the electrode pads are made of a refractory metal such as tungsten or molybdenum.

However, since the ceramic base and the electrode pads are made of different materials, a problem relating to adhesion therebetween may occur. In particular, ceramic heaters tend to be repeatedly used at high temperature or in such a manner as to receive a mechanical load. Therefore, one or both of the ceramic pads may peel off of the ceramic base.

In view of the above, a method has been proposed in which a glass component is introduced into unfired electrode pads from an unfired ceramic base during firing so as to increase the strength of joining of a ceramic base and electrode pads by the bonding ability of the glass component (JP-A-49-076711 and JP-A-57-082188). The unfired ceramic base and the unfired electrode pads become a ceramic base and electrode pads when the firing has been completed. Another method has been reported in which the strength of joining of a ceramic base and electrode pads is increased by applying a joining material containing a ceramic material powder of an unfired ceramic base and a metal powder of unfired electrode pads to the joining surfaces of the unfired ceramic base and the unfired electrode pads followed by firing (JP-A-58-120579).

Ceramic heaters also tend to be used repeatedly at a high temperature or in such manner as to receive a mechanical load. Thus, as is the case for joining the connection terminals and electrode pads, one or both of the connection terminals may peel off of the electrode pads. In this regard, a method for increasing the bonding strength between the electrode pads and the connection terminals is known in which the composition of a brazing material is determined so as to attain a high bonding ability between the electrode pads and the connection terminals (JP-A-11-292649).

3. Problems to be Solved by the Invention

However, particularly in recent methods of using ceramic heaters in which the operating temperature is set at even higher temperatures and having a high repetition frequency or cycling rate of heating and cooling operations, the above-described conventional techniques cannot provide sufficient bonding strength between the ceramic base and the electrode pads and between the electrode pads and the connection terminals. As a result, it has become difficult to obtain ceramic heaters having a sufficiently long life.

SUMMARY OF THE INVENTION

In view of the above, an object of the present invention is to provide a ceramic-metal assembly and a ceramic heater in which high adhesion between an electrode pad and connection terminal and between a ceramic base and the electrode pad is maintained even under severe operating conditions including a high cycling rate of high- and low-temperature operations.

The above object has been achieved by providing a ceramic-metal assembly having a ceramic base, an electrode pad provided on a surface of the ceramic base, a connection terminal for external electrical connection, and a joining portion which joins the connection terminal to the electrode pad, wherein the electrode pad comprises a first layer which is in contact with the ceramic base and a second layer which is in contact with the joining portion; the first layer contains a ceramic component is an amount of from 20 to 50 vol %; and the second layer contains a component of the joining portion. The first layer preferably has a thickness of from 10 to 20 μm, and the second layer preferably has a thickness of from 10 to 20 μm.

In the invention, the ceramic component content of the first layer which is in contact with the ceramic base is from 20 to 50 vol %. This increases the adhesion between the ceramic base and the electrode pad (i.e., first layer) and hence can prevent the electrode pad from peeling off of the ceramic base. If the ceramic content is lower than 20 vol %, the above-noted effect is difficult to attain. On the other hand, if the ceramic content is higher than 50 vol %, the electrical conductivity of the electrode pad becomes low. Non-limiting examples of the ceramic component for use in the invention include alumina, magnesia, silica, spinel, mulite and the like.

On the other hand, because the second layer which is in contact with the joining portion contains a component of the joining portion (i.e., a part of the joining portion is introduced into the second layer), the adhesion between the joining portion and the electrode pad (e.g., second layer) is increased to thereby prevent the connection terminal from peeling off of the electrode pad.

In the ceramic-metal assembly according to the invention, the second layer preferably has a porosity of 10 vol % to 50 vol %. Setting the porosity of the second layer at a level of from 10 vol % to 50 vol % allows the component of the joining portion to sufficiently impregnate the second layer. If the porosity is smaller than 10 vol %, the amount of the component of the joining portion that is impregnated into the second layer is too small to attain the above effect. On the other hand, if the porosity is larger than 50 vol %, the adhesion between the first layer and the second layer may become unduly low. This is because too large an amount of the impregnated component of the joining portion increases internal stress in the electrode pad. The term "porosity" means a ratio of the total volume of portions that can contain or rather receive a component of the joining portion to the entire volume of the second layer. The entire volume of the second layer is the volume of a region obtained by imaginarily connecting ridges of the second layer. The entire volume of the first layer is likewise defined. The portions of the second layer that can contain a component of the joining portion are charged portions plus voids (i.e., those portions that can inherently be charged with the component of the joining portion but which have not been charged due to an actual amount of impregnation and other factors). Preferably, the component of the joining portion is impregnated into the second layer in an amount of 90 vol % or more of the pores present in the second layer (i.e., those portions of the second layer which can contain or rather receive the component of the joining portion).

In the ceramic-metal assembly according to the invention, the first layer preferably has a porosity of 3 vol % or less. By setting the porosity of the first layer to 3 vol % or less, it is possible to lower the amount of the component of the joining portion that is impregnated into the first layer.

In the ceramic-metal assembly according to the invention, preferably the first layer substantially does not contain a component of the joining portion. This makes it possible to secure sufficiently high adhesion between the ceramic base and the first layer and hence prevent the electrode pad from peeling off of the ceramic base. The term "substantially does not contain a component of the joining portion" means that the first layer does not contain the component of the joining portion other than in unavoidable amounts.

In the ceramic-metal assembly according to the invention, it is preferable that the porosity (vol %) of the electrode pad preferably increases at positions coming closer to (i.e., nearing) the joining portion (i.e., in the thickness direction toward the joining portion). For example, when the electrode pad is composed of two porous layers (the first layer and the second layer), the porosity of the second layer is larger than that of the first layer. When the electrode pad is composed of three porous layers (a first layer, an intermediate layer, and a second layer arranged in this order), the porosity of the intermediate layer lies halfway between those of the first layer and the second layer. If the porosity of the intermediate layer is smaller than that of the first layer, the adhesion between the second layer and the intermediate layer may become unduly low. This is because the component of the joining portion is not easily impregnated into the intermediate layer, although high adhesion could be attained between the first layer and the intermediate layer. On the other hand, if the porosity of the intermediate layer is larger than that of the second layer, the adhesion between the first layer and the second layer may become unduly low. However, even higher adhesion can be attained between the second layer and the intermediate layer when the component of the joining portion is easily impregnated into the intermediate layer. Therefore, even in a multilayer structure of three or more layers, by setting the porosity profile so that the porosity increases at positions coming closer to the joining portion, it is possible to attain even higher adhesion between the joining portion and the electrode pad while securing sufficient adhesion between the ceramic base and the electrode pad.

In the ceramic-metal assembly according to the invention, the second layer preferably contains the ceramic component in an amount of 10 vol % or less. By setting the ceramic component content low, it is possible to attain even higher adhesion between the joining portion and the electrode pad. This is because the difference between the thermal expansion coefficients of the second layer and the joining portion is decreased.

In the invention, the ceramic component contained in the first layer and that contained in the second layer can be independently selected as appropriate. However, an arrangement in which the first layer and the second layer contain the same ceramic component (in terms of composition) as the ceramic body is best in terms of adhesion.

The content of the ceramic component (vol %) of the electrode pad preferably increases at positions coming closer to the ceramic base (i.e., in the thickness direction toward the ceramic base). For example, when the electrode pad is composed of two porous layers (the first layer and the second layer), the ceramic component content of the first layer is larger than that of the second layer. When the electrode pad is composed of three porous layers (a first layer, an intermediate layer, and a second layer arranged in this order), the ceramic component content of the intermediate layer lies halfway between the ceramic component contents of the first layer and the second layer. If the ceramic component content of the intermediate layer is approximately equal to that of the first layer, the adhesion between the second layer and the intermediate layer may become unduly low. This is because the component of the joining portion is not easily impregnated into the intermediate layer, although high adhesion could be attained between the first layer and the intermediate layer. On the other hand, if the ceramic component content of the intermediate layer is approximately equal to that of the second layer, the adhesion between the first layer and the second layer may become unduly low. However, even higher adhesion can be attained between the joining portion and the electrode pad when the component of the joining portion is easily impregnated into the intermediate layer. Therefore, by setting the ceramic component content profile so that the ceramic component content increases at positions coming closer to the ceramic base, it is possible to attain even higher adhesion between the joining portion and the electrode pad while securing sufficient adhesion between the ceramic base and the electrode pad.

Preferably, the ceramic-metal assembly preferably comprises an internal wiring line which is buried in the ceramic base and a via conductor (including one or more via conductors) which connects the internal wiring line to the electrode pad; the internal wiring line and the via conductor contain the ceramic component; and the content of the ceramic component of the internal wiring line and the via conductor is lower than or equal to that of the first layer. The ceramic-metal assembly is provided with an internal wiring line such as a heating body, electrodes, etc., and one or more via conductors which electrically connect the internal connection line to the electrode pad. To increase adhesion to the ceramic base, the internal wiring line and the via conductor may contain the ceramic component. In this case, the function of the internal wiring line and sufficient electrical conductivity of the internal wiring line and the via conductor(s) are maintained by setting the ceramic component content of the internal wiring line and the via conductor(s) lower than or equal to that of the first layer. Satisfactory results can be obtained as long as the ceramic component content of the internal wiring line and the via conductors is lower than or equal to that of the first layer, that is, the ceramic component content of the former need not be equal to that of the latter.

Furthermore, when the ceramic-metal assembly according to the invention is used in a ceramic heater, high adhesion between the electrode pad and the connection terminal and between the ceramic base and the electrode pad can be maintained even when used under severe operating conditions including a high cycling rate of high- and low-temperature operations.

As used herein, the articles "a" and "an" include plural objects. Thus, for example, "an electrode pad" means one or more electrode pads, "a connection terminal" means one or more connection terminals, etc.

DESCRIPTION OF REFERENCE NUMERALS

Figure 1:
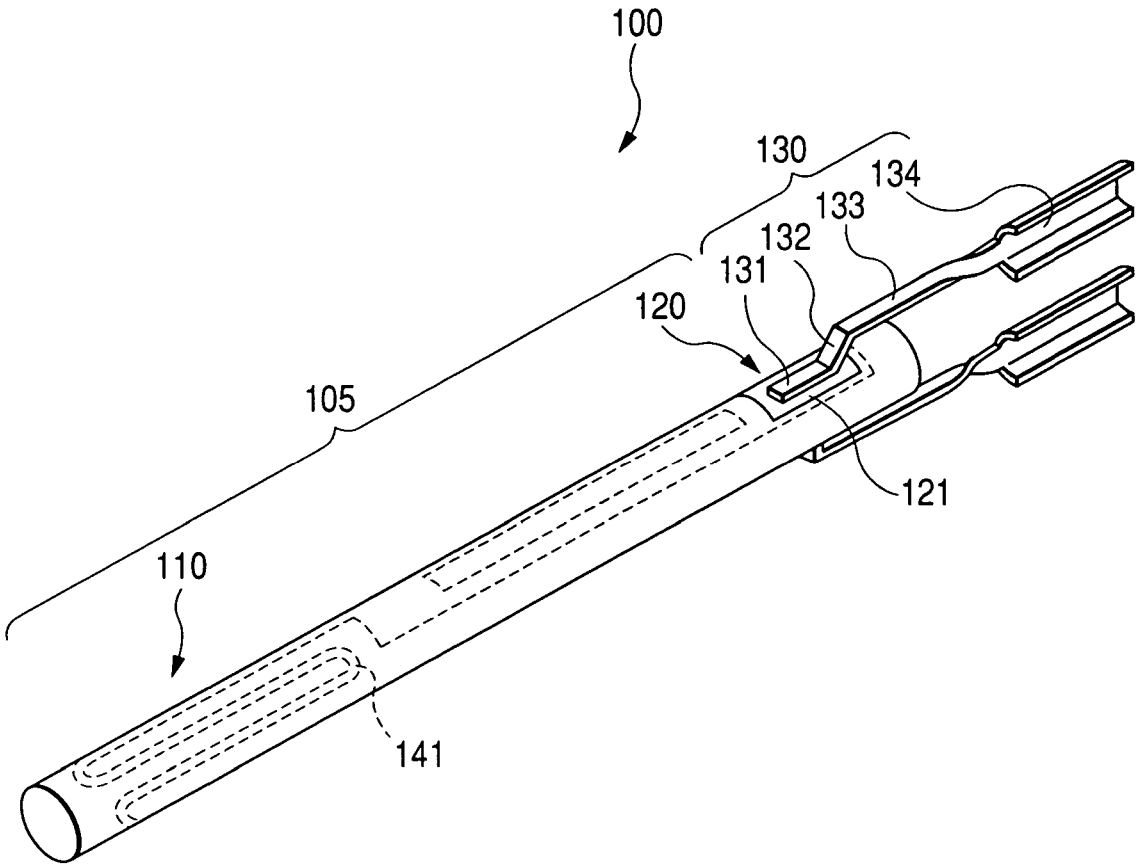
FIG. 1 is a perspective view of a ceramic heater 100.

Reference numerals used to identify various structural features in the drawings include the following.

100: Ceramic heater; 105: Base; 110: Heating portion; 120, 220: Electrode portion; 121, 221: Electrode pad; 122, 222: First layer; 123, 223: Second layer; 224: Intermediate layer; 124: Brazing material portion; 130: Connection terminal.

DETAILED DESCRIPTION OF THE INVENTION

Ceramic heaters according to embodiments of the present invention will be hereinafter described with reference to the drawings. However, the present invention should not be construed as being limited thereto.

Figure 2:
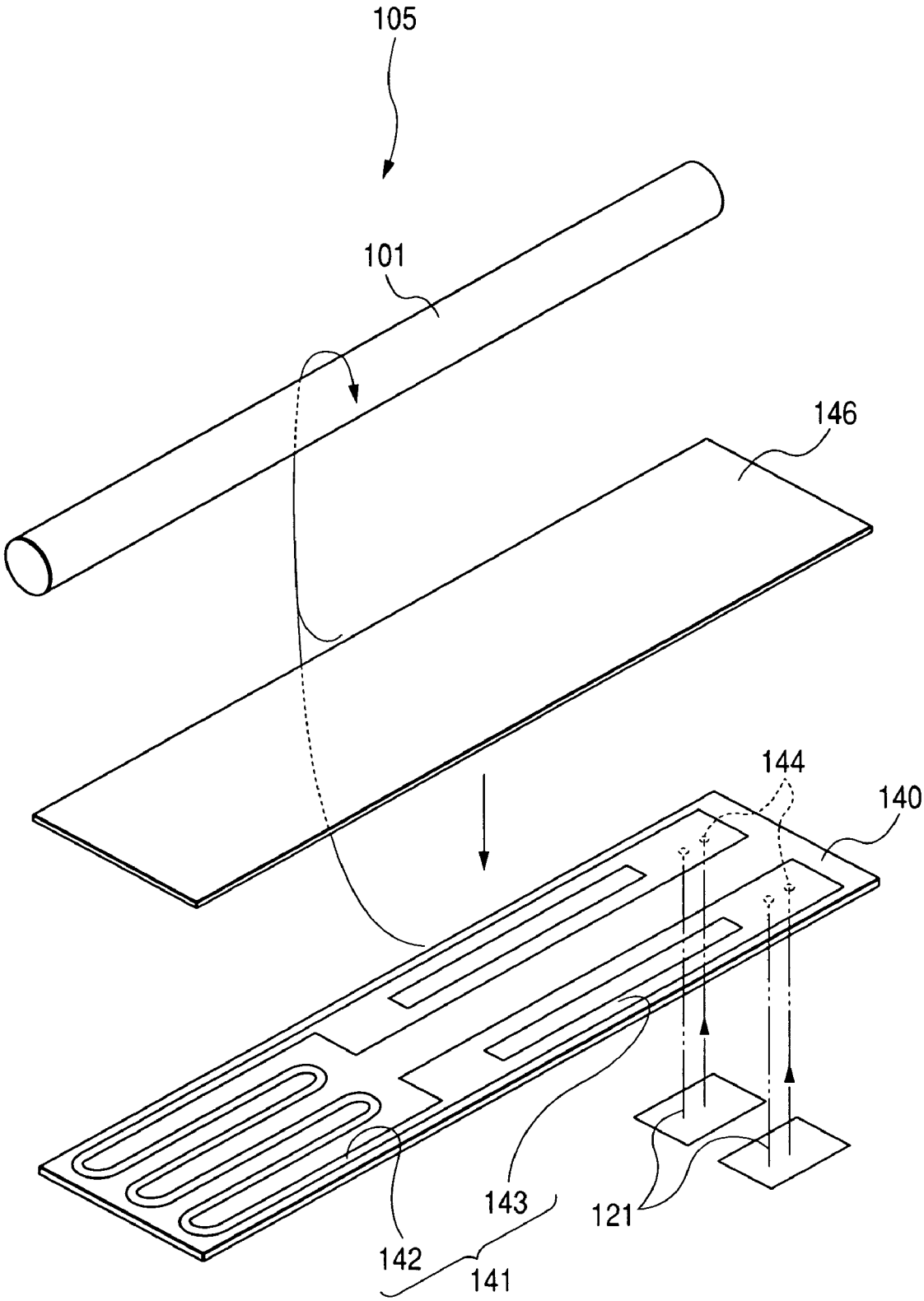
FIG. 2 is an exploded perspective view of a base 105 of the ceramic heater 100.
Figure 3:
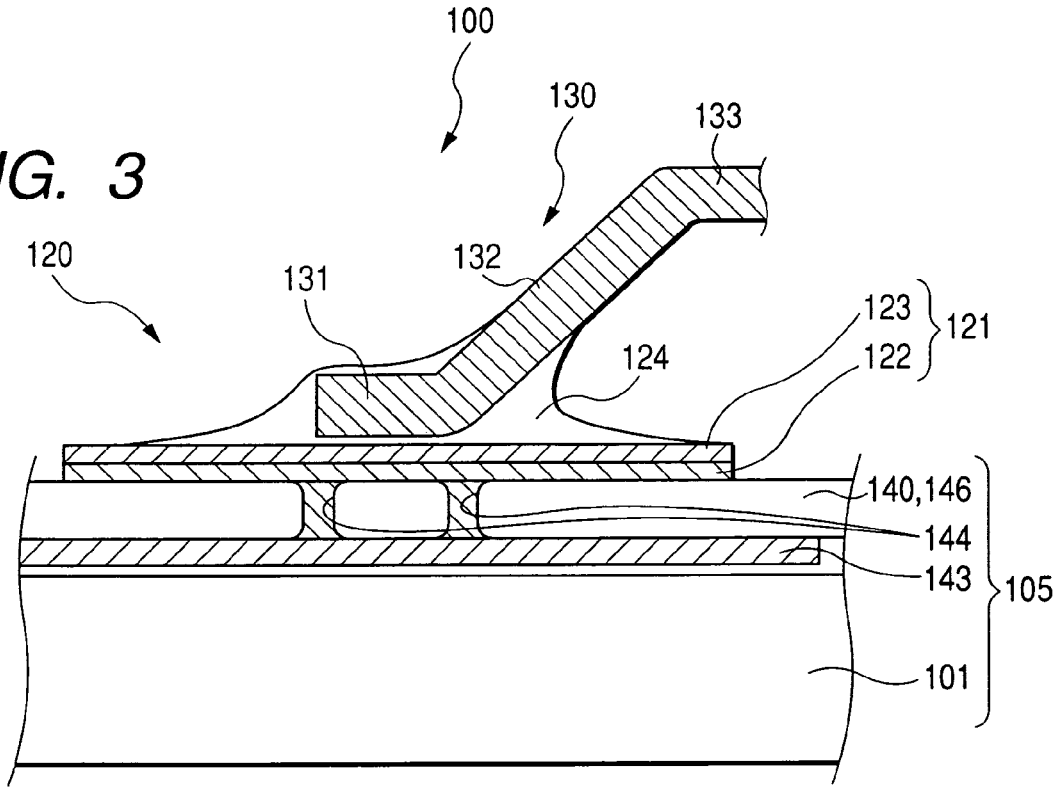
FIG. 3 is an enlarged sectional view of an electrode portion 120 of the ceramic heater 100 according to an embodiment of the invention.

First, the configuration of a ceramic heater 100 will be described with reference to FIGS. 1-3. FIG. 1 is a perspective view of the ceramic heater 100. FIG. 2 is an exploded perspective view of a base 105 of the ceramic heater 100. FIG. 3 is an enlarged sectional view of an electrode portion 120 of the ceramic heater 100. The heating portion 110 side of the ceramic heater 100 and the electrode portion 120 side will be referred to as a tip side and a rear side, respectively.

The ceramic heater 100 is inserted in a sensor element (not shown) in which electrode layers are formed on the inner and outer surfaces of a solid electrolyte tube having a closed-end cylinder shape, and the thus-inserted ceramic heater 100 serves to heat the sensor element. As shown in FIG. 1, the base 105 of the ceramic heater 100 has a circular rod shape. A heating resistor 141 is buried in the base 105. The heating portion 110 provided on the tip side generates heat when supplied with a voltage from the electrode portion 120 which is provided on the rear side. The base 105 corresponds to the term "ceramic base" as used herein.

As shown in FIG. 2, the base 105 of the ceramic heater 100 is produced by winding green sheets 140 and 146 made of highly insulative alumina ceramics around the outer circumferential surface of a porcelain tube 101 made of alumina ceramics and having a circular rod shape, and then firing the resulting structure. A tungsten-based heating resistor 141 as a heating pattern is formed on the green sheet 140. The heating resistor 141 is composed of a heat generating portion 142 which is formed at a position corresponding to the heating portion 110 (see FIG. 1) and a pair of lead portions 143 which are connected to the two respective ends of the heat generating portion 142. Through-holes 144 are formed at positions corresponding to rear end portions of the lead portions 143. Two electrode pads 121 formed on the outer circumferential surfaces of the base 105 are electrically connected to the lead portions 143 via the through-holes 144, respectively. To increase the adhesion to the base 105, among the above members, the heating resistor 141 and conductors in the through-holes 144 contain, at 35 vol %, the same alumina content as the base 105 (i.e., green sheets 140 and 146). The heating resistor 141 and the conductors in the through-holes 144 correspond to the terms "internal wiring line" and "via conductors" as used herein, respectively.

The green sheet 146 is a sheet that is compression-bonded to that surface of the green sheet 140 on which the heating resistor 141 is formed. A ceramic heater formed body is formed by applying an alumina paste to the surface, opposite to the compression bonding surface, of the green sheet 146, winding the green sheets 140 and 146 around the porcelain tube 101 with the paste application surface inside, and pressing the outer surface of the combination of the green sheets 140 and 146. The base 105 of the ceramic heater 100 is formed by firing the ceramic heater formed body.

Furthermore, as shown in FIGS. 1 and 2, the two, that is, anode side and cathode side, electrode pads 121 are formed in the electrode portion 120 of the base 105 of the ceramic heater 100. The electrode pads 121 are formed on the outer surface of the green sheet 140 at two respective positions corresponding to four (i.e., two sets of) through-holes 144 (see FIG. 2). The conduction between the electrode pads 121 and the lead portions 143 of the 12 heating resistor 141 is attained by a conductive paste printed on the inner surfaces of the through-holes 144.

As shown in FIG. 3, each electrode pad 121 is composed of two porous layers, that is, a first layer 122 which is joined to the base 105 and a second layer 123 which is formed on the first layer 122. The first layer 122 and the second layer 123 are mainly made of tungsten, molybdenum, or the like. The first layer 122 contains, at 45 vol %, the same alumina content as the base 105. Setting the ceramic component content of the first layer 122 at 20 to 50 vol % as in this case increases the adhesion between the electrode pad 121 (specifically the first layer 122) and the base 105, and hence can prevent the electrode pad 121 from peeling off of the base 105.

The ceramic component content of each of the heating resistor 141 and the conductor in each through-hole 144 is lower than that of the first layer 122. With this measure, good heating performance of the heating resistor 141 is maintained, and the heating resistor 141 and the conductors in the through-holes 144 remain electrically conductive.

The first layer 122 substantially does not contain the components of a brazing material portion 124 (described below), which makes it possible to secure sufficient adhesion between the base 105 and the first layer 122 and to thereby prevent the electrode pad 121 from peeling off of the base 105. In this embodiment, the porosity of the first layer 122 is set lower than or equal to 3 vol % (e.g. 1 vol %).

On the other hand, the second layer 123 contains components of the brazing material portion 124. This increases the adhesion between the brazing material portion 124 and the electrode pad 121 and hence can prevent a connection terminal 130 (described below) from peeling off of the electrode pad 121. In this embodiment, the porosity of the second layer 123 is set at 40 vol %. Setting the porosity of the second layer 123 at 10 vol % to 50 vol % as in this case makes it possible to sufficiently impregnate the components of the brazing material portion 124 into the second layer 123.

The second layer 123 contains, at 6 vol %, the same alumina content as the base 105. Setting the ceramic component content of the second layer 123 lower than or equal to 10 vol % as in this case facilitates impregnation of the components of the brazing material portion 124 into the second layer 123. Hence, this makes it possible to attain high adhesion between the brazing material portion 124 and the electrode pad 121. As described above, the ceramic component content of the second layer 123 is even lower than that of the conductors in the through-holes 144.

A counter portion 131 and a connecting portion 132 of each of connection terminals 130 for applying an external voltage to the ceramic heater 100 are joined to the corresponding electrode pad 121 with a silver-based brazing material portion 124 (see FIG. 3). Each connection terminal 130 has a plate rod shape and is made of a nickel alloy. The connecting portion 132 and the counter portion 131 are formed by bending one end portion of an originally straight trunk portion 133 so that a step is formed in the thickness direction. More specifically, the connecting portion 132 and the counter portion 131 are formed by bending one end portion of the trunk portion 133 to one side and then bending its tip portion to the other side so as to form a step. The brazing material portions 124 for joining the connection terminals 130 to the electrode pads 121 when solidified correspond to the term "joining portion" as used herein.

A crimping portion 134 to which a lead wire for connection to an external circuit is to be fixed by crimping is formed in the other end portion of the trunk portion 133 (see FIG. 1). More specifically, the other, wide end portion of the trunk portion 133 is twisted about the longitudinal direction of the trunk portion 133 by about 90° and its two side flanges are bent to the same direction to form a crimping structure for fixing a lead wire. The ceramic base 105, the electrode pads 121, the brazing material portions 124, and the connection terminals 130 constitute a "ceramic-metal assembly" of the invention.

Next, the joining of each of respective electrode pads 121 and connection terminals 130 will be described. First, a plating layer (not shown) of Ni or the like is formed on the electrode pad 121 (i.e., the second layer 123). This plating layer can promote impregnation of the components of the brazing material portion 124 into the second layer 123. Then, the counter portion 131 of the connection terminal 130 is placed on the electrode pad 121 and a silver brazing alloy is applied so as to cover the counter portion 131 and to extend across the electrode pad 121. A brazing material portion 124 is formed when the silver brazing alloy is solidified. In this embodiment, the plating layer is mixed with the brazing material portion 124 and is dissolved therein (i.e., the plating layer disappears as a distinct layer). To prevent corrosion, etc., of the brazing material portion 124, a plating layer (not shown) of Ni or the like is formed so as to cover the brazing material portion 124. The electrode pad 121 and the connection terminal 130 are thus joined to each other.

Figure 4:
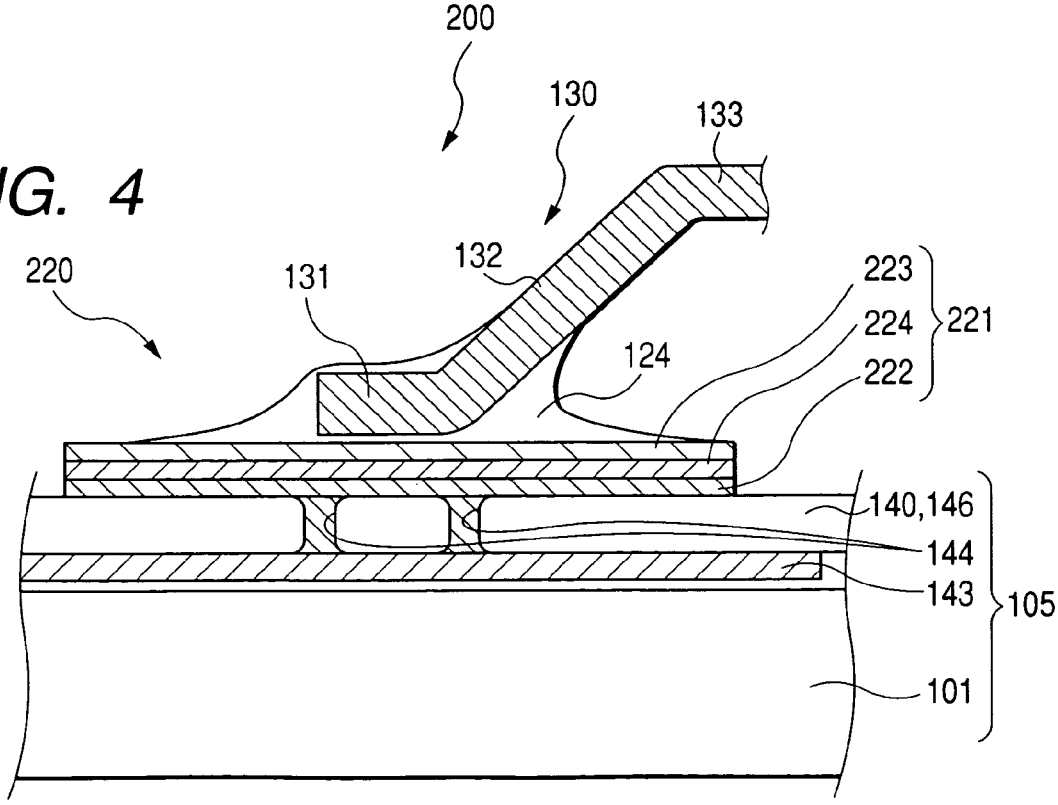
FIG. 4 is an enlarged sectional view of an electrode portion 220 of a ceramic heater 200 according to another embodiment of the invention.

Next, another embodiment of the invention will be described with reference to FIG. 4. FIG. 4 is an enlarged sectional view of an electrode portion 220 of a ceramic beater 200. The ceramic heater 200 according to this embodiment is the same as the ceramic heater 100 according to the above embodiment except for the structure of electrode pads 221. The other components of the ceramic heater 200 will be given the same reference numerals as the corresponding components of the ceramic heater 100 and redundant descriptions will be omitted.

As shown in FIG. 4, two, that is, anode side and cathode side, electrode pads 221 are formed in the electrode portion 220 of the base 105 of the ceramic heater 200. The counter portion 131 of each connection terminal 130 for applying an external voltage to the ceramic heater 200 is joined to the corresponding electrode pad 221 with a silver-based brazing material portion 124.

Each electrode pad 221 is composed of three metal layers, that is, a first layer 222 which is joined to the base 105, an intermediate layer 224 which is formed on the first layer 222, and a second layer 223 which is formed on the intermediate layer 224. The first layer 222, the second layer 223, and the intermediate layer 224 are mainly made of tungsten, molybdenum, or the like. The first layer 222 contains 45 vol % alumina, and substantially does not contain components of the brazing material portion 124. On the other hand, the second layer 123 contains 5 vol % alumina and does contain components of the brazing material portion 124.

The intermediate layer 224 contains 25 vol % alumina and has a porosity of 20 vol %. That is, the porosity increases in order of the first layer 222, the intermediate layer 224, and the second layer 223, that is, at positions closer to the brazing material portion 124. As a result, high adhesion can be attained between the brazing material portion 124 and the electrode pad 221 while sufficient adhesion is secured between the base 105 and the electrode pad 221. The ceramic component content increases in order of the second layer 223, the intermediate layer 224, and the first layer 222, that is, at positions coming closer to the base 105. This is also effective in attaining high adhesion between the brazing material portion 124 and the electrode pad 221, while securing sufficient adhesion between the base 105 and the electrode pad 221.

EXAMPLES

Example 1

A slurry was produced by mixing material powders of alumina (93 wt %) and a sintering aid (7 wt %), and a 0.3-mm-thick flat plate was formed from this slurry by a doctor blade method. A plate-like green sheet 140 of 60 mm in length and 10 mm in width was produced by punching the flat plate. Four through-holes 144 for electrical connection to electrode pads 121 were formed in the green sheet 140, and a heating resistor 141 was printed on one surface of the green sheet 140 by applying a metal paste mainly made of tungsten from around the four through-holes. The metal paste was also charged into the through-holes 144 to secure electrical continuity.

Then, two two-layer electrode pads 121 were formed on the other surface of the green sheet 140 by pattern printing with a metal paste that was prepared separately for each sample. Each electrode pad 121 measured approximately 2.5 mm×5 mm. A green sheet 146 made of the same material as the green sheet 140 was laminated on that surface of the green sheet 140 on which the heating resistor 141 was formed, and the green sheets 140 and 146 were wound around a separately produced porcelain tube 101 made of alumina and measuring 60 mm in length, 10 mm in outer circumference, and 3 mm in inner circumference. The resulting structure was fired at 1,500° C. to 1,550° C. in a firing furnace, whereby a fired body was produced for each sample. The thickness of the electrode pads 121 of the fired body was about 15 to 20 μm.

For the electrode pads 121, the alumina content of the first layer 122 (having a thickness of 15 μm), the degree of impregnation of the first layer 122, and the porosity of the second layer 123 (having a thickness of 15 μm) were measured for each sample. As for the alumina content of the first layer 122, one sintered body was taken for each sample and a cross section of the sintered body was polished and subjected to EPMA (Electron Probe Micro Analysis) quantitative analysis. More specifically, the position of a beam having a prescribed diameter (equal to the thickness of the metallization layer) was adjusted in the thickness direction of the metallization layer so that the beam was aligned with the metallization layer. Alumina contents were measured at four positions and their average was employed. As for the degree of impregnation of the first layer 122 and the porosity of the second layer 123, measurements were performed on the above-mentioned sintered body using a SEM reflection electron image. More specifically, the degree of impregnation of the first layer 122 was measured by utilizing a difference in contrast between metallization portions and pores. As for the porosity of the second layer 123, ratios were determined by analyzing images taken at four positions and their average was employed. Table 1 shows the measurement results. In Table 1, as for the degree of impregnation, mark "o" means that the first layer 122 is impregnated and mark "x" means that the first layer 122 is not impregnated. Then, the electrode pads 121 of the sintered body were plated with Ni.

In more detail, the present inventors confirmed that the first layer 122 was not impregnated with the components of the brazing material portion by the following method.

Method for determination:

EDS analyzer (Model Number: EX-23000UB, produced by JEOL Ltd.) of FE-SEM (field-emission scanning electron microscope) (Model Number: JSM-6500F, produced by JEOL Ltd.) was used.

Condition for measurement:

Accelerating voltage: 15 to 20 kV (15 kV)

Probe current: 1 to $3\times10^{-10}$ A ($2\times10^{-10}$ A)

Working distance: 10 mm

Criteria for judgment:

A square having a side length about half the thickness of first layer is taken as a field of measurement, and the measurement is made at three or more points. If a peak of element of the joining portion (brazing material portion) is not detected at those points, the sample is judged as "x" (meaning not impregnated).

On the other hand, each connection terminal 130 was produced from a small piece prepared by punching a 0.3-mm-thick nickel plate that was 15 mm in length and 1 mm in width and which had a generally T-shaped tip portion. The counter portions 131 of the connection terminals 130 were placed on the respective electrode pads 121 of the sintered body and brazed to the electrode pads 121 with a silver brazing alloy, whereby brazing material portions 124 were formed. Then, Ni plating layers were formed so as to cover the brazing material portions 124, whereby a ceramic heater 100 as shown in FIG. 1 was completed.

The adhesion of the thus-manufactured ceramic heater 100 was evaluated. More specifically, the ceramic heater 100 of each sample was subjected to 500 heating-cooling cycles, each cycle comprising heating at 400° C. for 5 minutes and then cooling, that is, being kept at room temperature, for 5 minutes. After the ceramic heaters 100 were subjected to the heating-cooling cycles, the peeling resistance of the connection terminals 130 of the ceramic heaters 100 of Samples 1 to 6 from the electrode pads 121 was evaluated. More specifically, the trunk portion 133 of each connection terminal 130 was bent to a direction perpendicular to the axis of the base 105 of each ceramic heater 100 and the connection terminal 130 was pulled in that direction by a force of 3 kg. The peeling state of connection terminal 130 from the base 106, and the position where the peeling occurred (if peeled), were observed. The results are shown in Table 1.

It is seen from Table 1 that in Sample No. 1 the 10 vol % alumina content of the first layer 122 was too low, and peeling occurred at the boundary between the base 105 and the first layer 122. In Sample No. 4, the second layer 123 was not impregnated with the components of the brazing material portion 124, and peeling occurred at the boundary between the brazing material portion 124 and the second layer 123. On the other hand, in Sample Nos. 2 and 3, the electrode pads 121 were not peeled off of the base 105 and cracks did not develop. In Sample Nos. 5 and 6, peeling did not occur but cracks partially developed.

Then, the electrical conductivity of the ceramic heaters 100 of Sample Nos. 1 to 6 was measured. More specifically, the resistance between the anode-side and cathode-side connection terminals 130 of each ceramic heater 100 was measured. The results are also shown in Table 1.

As seen from Table 1, whereas Sample Nos. 1, 2 and 4 to 6 had a resistance of 6Ω, Sample No. 3 had a higher resistance of 6.3Ω due to the high alumina content of the first layer 122.

Although certain embodiments of the invention have been described above, the invention is not limited thereto and various modifications may be made within the spirit and scope of the claims appended hereto. For example, although in the above embodiments the connection terminals 130 are made of a nickel alloy, the invention is not so limited. For example, the connection terminals 130 may be made of other metals such as copper, nickel, iron and an alloy thereof. Although in the embodiments connection terminal 130 is formed by bending a plate material, it may be formed by shaving a metal member, press working, casting, or the like. The shape of the connection terminal 130 is not limited to a plate-like shape. For example, at least the counter portion 131, the connecting portion 132, and the trunk portion 133 may be shaped like a circular rod or a polygonal prism. The brazing material of the brazing material portions 124 may be one of metals such as copper, gold, and nickel or an alloy thereof. The shape of the base 105 of the ceramic heater 100 is not limited to a circular rod shape and may assume a plate-like shape.

The connection-terminal-joined ceramic heater according to the invention can be used in broad fields as a long-life, highly reliable heater. The ceramic heater of the invention performs accurate temperature control in an environment in which it is used repeatedly under a high-temperature condi-

TABLE 1

| | 1st layer | | | | | |
|---|---|---|---|---|---|---|
| Sample No. | Alumina content (vol %) | Degree of impregnation | 2nd layer Porosity (vol %) | Peeling state | Peeling position | Resistance (Ω) |
| 1 | 10 | X | 40 | Peeled | Boundary between base and 1st layer | 6 |
| 2 | 45 | X | 40 | Not peeled | Not peeled | 6 |
| 3 | 60 | X | 40 | Not peeled | Not peeled | 6.3 |
| 4 | 45 | X | 0 | Peeled | Boundary between brazing material portion and 2nd layer | 6 |
| 5 | 45 | X | 70 | Cracks | Boundary between first layer and second layer | 6 |
| 6 | 45 | ○ | 40 | Cracks | Boundary between base and 1st layer | 6 |

tion and is required to have high mechanical strength such as heaters for sensors, semiconductor manufacturing, and other purposes.

This application is based on Japanese Patent Application JP 2005-176903, filed Jun. 16, 2005, the entire content of which is hereby incorporated by reference, the same as if set forth at length.

What is claimed is:

1. A ceramic-metal assembly comprising: a ceramic base; an electrode pad provided on a surface of the ceramic base; a connection terminal for external electrical connection; and a joining portion which joins the connection terminal to the electrode pad, wherein:

the electrode pad comprises a first layer which is in contact with the ceramic base and a second layer which is in contact with the joining portion;

the first layer is made of tungsten or molybdenum and further contains 20 to 50 vol % of a ceramic component; and the second layer is made of tungsten or molybdenum and further contains a component of the joining portion, wherein the second layer has a porosity of 10 vol % to 50 vol %.

2. The ceramic-metal assembly as claimed in claim 1, wherein the first layer has a porosity of 3 vol % or less.

3. The ceramic-metal assembly as claimed in claim 1, wherein the first layer substantially does not contain a component of the joining portion.

4. The ceramic-metal assembly as claimed in claim 1, wherein the electrode pad has a porosity which increases at positions coming closer to the joining portion.

5. The ceramic-metal assembly as claimed in claim 1, wherein the second layer contains a ceramic component in an amount of 10 vol % or less.

6. The ceramic-metal assembly as claimed in claim 1, wherein the electrode pad has a ceramic component content which increases at positions coming closer to the ceramic base.

7. The ceramic-metal assembly as claimed in claim 1, wherein the ceramic component comprises an insulating ceramic.

8. The ceramic-metal assembly as claimed in claim 1, wherein the ceramic component of the first layer has the same composition as that of the ceramic base.

9. The ceramic-metal assembly as claimed in claim 1, wherein:

the ceramic-metal assembly further comprises an internal wiring line provided in the ceramic base and a via conductor which connects the internal wiring line to the electrode pad;

the internal wiring line and the via conductor contain the ceramic component; and the internal wiring line and the via conductor each has a ceramic component content which is lower than or equal to that of the first layer.

10. The ceramic-metal assembly as claimed in claim 9, wherein the internal wiring line and the via conductor each has a ceramic component content which is lower than that of the first layer.

11. The ceramic-metal assembly as claimed in claim 10, further comprising a nickel-plated layer provided on the electrode pad.

12. The ceramic-metal assembly as claimed in claim 1, further comprising a nickel-plated layer provided on the electrode pad.

13. A ceramic heater comprising: a ceramic base; a heating resistor provided in the ceramic base; an electrode pad provided on a surface of the ceramic base for external electrical connection of the heating resistor, and a joining portion which joins the connection terminal to the electrode pad, wherein:

the electrode pad comprises a first layer which is in contact with the ceramic base and a second layer which is in contact with the joining portion;

the first layer is made of tungsten or molybdenum and further contains 20 to 50 vol % of a ceramic component; and the second layer is made of tungsten or molybdenum and further contains a component of the joining portion, wherein the second layer has a porosity of 10 vol % to 50 vol %.

14. A ceramic-metal assembly comprising: a ceramic base; an electrode pad provided on a surface of the ceramic base; a connection terminal for external electrical connection; and a joining portion which joins the connection terminal to the electrode pad, wherein:

the electrode pad comprises a first layer which is in contact with the ceramic base and a second layer which is in contact with the joining portion;

the first layer is made of tungsten or molybdenum and further contains 20 to 50 vol % of a ceramic component; and the second layer is made of tungsten or molybdenum and further contains a component of the joining portion, wherein the first layer has a porosity of 3 vol % or less.

15. A ceramic heater comprising: a ceramic base; a heating resistor provided in the ceramic base; an electrode pad provided on a surface of the ceramic base for external electrical connection of the heating resistor, and a joining portion which joins the connection terminal to the electrode pad, wherein:

the electrode pad comprises a first layer which is in contact with the ceramic base and a second layer which is in contact with the joining portion;

the first layer is made of tungsten or molybdenum and further contains 20 to 50 vol % of a ceramic component; and the second layer is made of tungsten or molybdenum and further contains a component of the joining portion, wherein the first layer has a porosity of 3 vol % or less.

* * * * *